US006206321B1

(12) United States Patent
Pumpe

(10) Patent No.: US 6,206,321 B1
(45) Date of Patent: Mar. 27, 2001

(54) REEL CUTTER FOR A MATERIAL WEB AND METHOD OF USING THE SAME

(75) Inventor: Rainer Klaus Pumpe, Krefeld (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/231,831

(22) Filed: Jan. 15, 1999

(30) Foreign Application Priority Data

Jan. 22, 1998 (DE) ..... 198 02 310

(51) Int. Cl.[7] ..... B65H 35/02
(52) U.S. Cl. ..... 242/525.3; 242/525.6
(58) Field of Search ..... 242/525.3, 525.6, 242/525.7, 530, 534; 83/110, 109, 100

(56) References Cited

U.S. PATENT DOCUMENTS

| | | | | |
|---|---|---|---|---|
| 841,037 | * | 1/1907 | McKinley | 242/525.6 X |
| 2,286,675 | * | 6/1942 | Gibbons | 242/525.3 |
| 2,394,859 | * | 2/1946 | Judelshon | 242/525.3 X |
| 2,751,981 | * | 6/1956 | Hawkins | 83/109 X |
| 3,226,049 | * | 12/1965 | Corbett | 242/525.3 X |
| 3,536,273 | * | 10/1970 | Hawkins | 242/525.3 X |
| 3,799,536 | * | 3/1974 | Gregoire | 493/359 |
| 3,844,201 | * | 10/1974 | Eggert et al. | 493/355 |
| 3,891,157 | * | 6/1975 | Justus . | |
| 4,221,145 | * | 9/1980 | Shimizu et al. . | |
| 4,431,142 | | 2/1984 | Kataoka . | |
| 4,467,975 | * | 8/1984 | Friedman | 242/525.3 |
| 4,697,755 | * | 10/1987 | Kataoka . | |
| 5,267,848 | * | 12/1993 | Totsuka | 425/297 |
| 5,474,248 | * | 12/1995 | Bradshaw et al. | 242/525.7 X |
| 5,787,777 | * | 8/1998 | Ballestrazzi et al. | 83/100 |
| 5,899,129 | * | 5/1999 | Sumida et al. | 83/100 X |

FOREIGN PATENT DOCUMENTS

| | | |
|---|---|---|
| 643816 | 5/1964 | (BE) . |
| 174143 | 11/1905 | (DE) . |
| 8207236 | 7/1982 | (DE) . |
| 4021573 | 2/1991 | (DE) . |
| 0538052 | 4/1993 | (EP) . |
| 724513 | 4/1932 | (FR) . |
| 981177 | 1/1965 | (GB) . |

OTHER PUBLICATIONS

Patent Abstracts of Japan, vol. 009, No. 286 (M–429), Nov. 13, 1985 and JP 60 128158 A, Jul. 9, 1985.
Patent Abstracts of Japan, vol. 009, No. 322 (M–440), Dec. 18, 1985 and IP 60 157452, Aug. 17, 1985.
V. Schick et al., "Rationelle Randstreifen–Rückgewinnung beim Herstellen von PVC–Kalanderfolien", *Kunststoffe*, Bd. 71, No. 2 (1981).

* cited by examiner

*Primary Examiner*—Donald P. Walsh
*Assistant Examiner*—Collin A. Webb
(74) *Attorney, Agent, or Firm*—Greenblum & Bernstein, P.L.C.

(57) ABSTRACT

A reel cutter for a material web and method of using the same that includes an inlet section, an outlet section, and a cutting device. The cutting device is between the inlet section and the outlet section. The cutting device contains an edge cutting device disposed in a region of at least one edge of the material web for producing at least one edge strip. The reel cutter is associated with a tensioning device that acts on the at least one edge strip.

1 Claim, 1 Drawing Sheet

REEL CUTTER FOR A MATERIAL WEB AND METHOD OF USING THE SAME

CROSS-REFERENCE TO RELATED APPLICATIONS

The present application claims priority under 35 U.S.C. § 119 of German Patent Application No. 198 02 310.3, filed Jan. 22, 1998.

BACKGROUND OF THE INVENTION

1. Field of the Invention

The present invention relates to a reel cutter for a material web and method of using the same, and more specifically to a reel cutter and method that provides a cut edge with a clean cut.

2. Discussion of Background Information

In the production of paper webs, the desired smooth edge end face in the winding roll, which is ultimately sold, is not always achieved. In the production of paper webs, the desired smooth edge resulting in an even end face in the winding roll which is ultimately sold is not always achieved. Generally, after being manufactured, the paper webs are ultimately cut into a number of partial webs to a width which can be used by a consumer, for example a printing plant. Therefore, this process of cutting the paper web into a number of partial webs can be used to also cut the edges of the paper web at the same time. Blades, or other cutting tools, are disposed in the cutting device, generally, in the region of the two longitudinal edges of the paper web, and are intended to smooth the edges of the paper web by virtue of the fact that they cut off a relatively narrow edge strip. The edge strips can be supplied directly to the paper plant in order to once more enter the production circuit.

At higher production speeds, it is observed that the cut edges do not exhibit the desired quality.

SUMMARY OF THE INVENTION

Accordingly, the present invention is directed to a reel cutter for a material web and method of using the same that substantially obviates one or more of the problems arising from the limitations and disadvantages of the related art.

It is an object of the present invention to improve the quality of the edge cut.

It is another object of the present invention to allow higher production speeds while still achieving a clean edge cut.

Accordingly, one aspect of the present invention is directed to a reel cutter for a material web that includes an inlet section, an outlet section, and a cutting device. The cutting device is between the inlet section and the outlet section. The cutting device includes an edge cutting device disposed in a region of at least one edge of the material web for producing at least one edge strip.

According to another aspect of the present invention, the edge cutting device is associated with a tensioning device that acts on the at least one edge strip.

According to yet another aspect of the present invention, the tensioning device includes a pinch roll pair.

In a further aspect of the present invention, the two rolls of the pinch roll pair protrude laterally beyond the at least one edge strip. The two rolls of the pinch roll pair act on a region of the material web extending laterally next to the one or more edge strips.

In another aspect of the present invention, a first roll of the pinch roll pair includes a guide roll for the material web after being cut.

In yet another aspect of the present invention, a second roll of the pinch roll pair includes a pinch roll, the second roll of the pinch roll pair acts only on the one or more edge strip and a neighboring strip of the material web.

According to a further aspect of the present invention, an edge strip receptacle is disposed after the tensioning device in a travel direction of the material web.

In still another aspect of the present invention, the edge strip receptacle includes a suction device.

According to yet another aspect of the present invention, a spreader device is disposed after the tensioning device.

According to a further aspect of the present invention, the tensioning device is followed by a subsequent treatment device. The subsequent treatment device treats the material web without the one or more edge strips.

In another aspect of the present invention, the tension of the subsequent treatment device and the tension of the tensioning device are matched to each other by a control device.

According to yet another aspect of the present invention, the invention includes a method for producing a clean edge cut from a material web that includes: passing a material web to a reel cutter; cutting the material web, the material web is cut into at least one partial web and at least one edge strip, the cutting is along at least one cutting line;

and providing a tension on the at least one partial web and the at least one edge strip. The tension is uniform on both sides of the at least one cutting line. Thereby, a clean cut is produced even at higher production speeds.

In still a further aspect of the present invention, the at least one edge strip is removed from the cut material web.

According to another aspect of the present invention, the at least one partial web is separated apart for subsequent treatment.

According to yet another aspect of the present invention, subsequent treatment for the at least one partial web is provided.

In a further aspect of the present invention, the subsequent treatment includes winding the at least one partial web.

In still another aspect of the present invention, the at least one edge strip is removed from the at least one partial web.

According to yet another aspect of the present invention, the removing includes using suction to remove the at least one edge strip from the at least one partial web.

In still a further aspect of the present invention, the tension is provided by a pinch roll pair.

In another aspect of the present invention, the tension on the at least one partial web and the at least one edge strip is matched to a subsequent treatment tension.

According to yet another aspect of the present invention, the tension on the at least one partial web and the at least one edge strip is controlled based on the subsequent treatment tension.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

Figure 1:
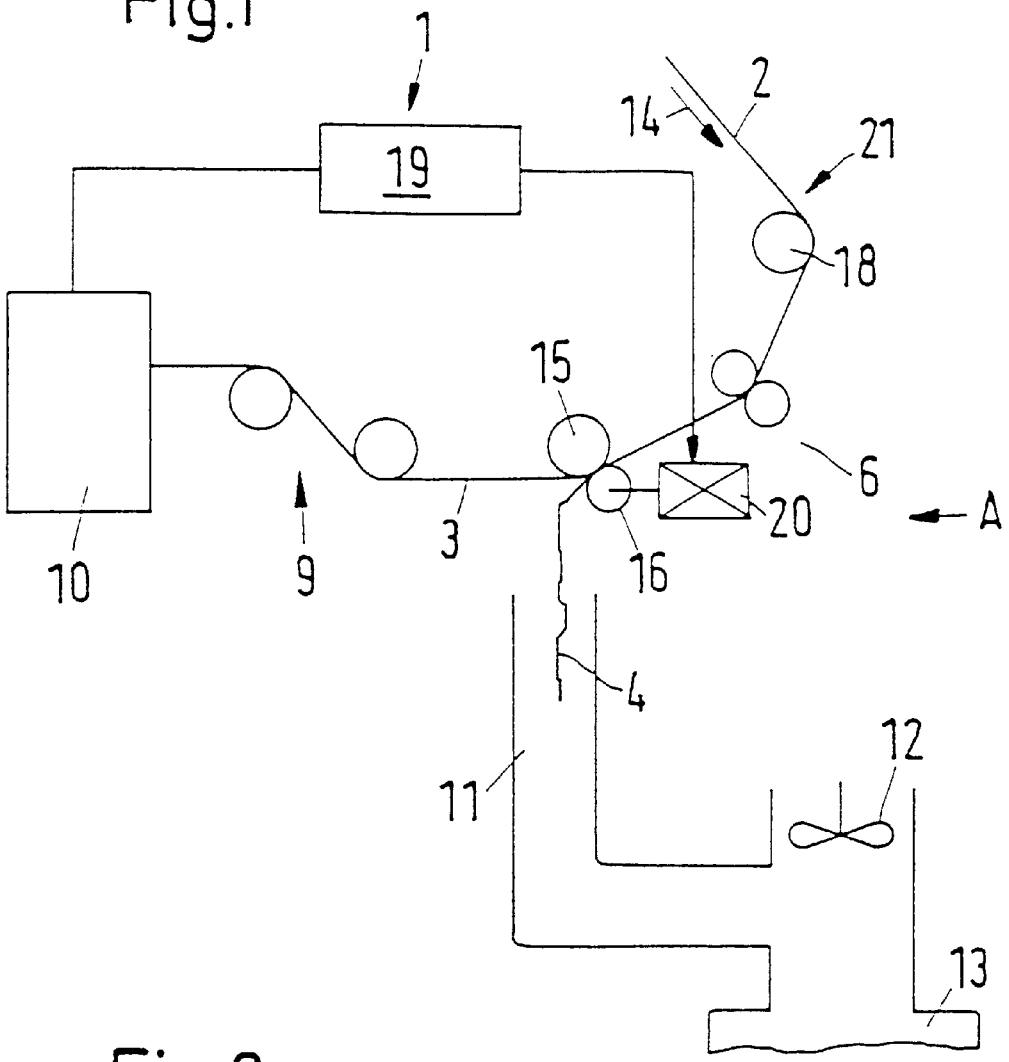
FIG. 1 is a schematic side view of an exemplary reel cutter.

The particulars shown herein are by way of example and for purposes of illustrative discussion of the embodiments of the present invention only and are presented in the cause of providing a most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The invention is described below in conjunction with a paper web as an example for the material web. The present invention may, however, also be used for other material webs, for example with foils made of plastic or metal, or with cardboard.

In a reel cutter according to the present invention, the edge cutting device is associated with a tensioning device that acts on the edge strips. A considerable improvement of the edge cut is achieved with this tensioning device. This arises from the fact that previously, the edge strips were not being stretched taut after the blades (of the edge cutting device), which had a negative influence on the cleanness of the cut.

Particularly at high speeds, the tension on the edge strips and on the remaining parts of the material web, or the cut partial webs, was different so that the cut was not clean. This problem may be solved with the tensioning device. The material web is acted on relatively uniformly on both sides of the edge cutting device (lateral to the direction of travel) so that a uniform cut is once again produced.

Preferably, the tensioning device according to the present invention may be embodied as a pair of pinch rolls. With a pinch roll pair, a relatively clearly defined tension can be exerted so that the edge strips are pulled with the required tension.

It is particularly preferable that both rolls of the pinch roll pair protrude laterally beyond the edge strips and impinge on a region of the material web traveling laterally next to the edge strips. In other words, the pinch roll pair at least covers the cutting line so that the main part of the material web, and the edge strips, are acted on with the same tension. This permits a very clean cut, particularly when the pinch roll pair is disposed relatively close to the edge cutting device.

One roll of the pinch roll pair may advantageously consist of a guide roll for the cut material web. Since the cut material web must be guided around the guide roll in any event in order to supply it to a subsequent treatment, this guide roll may also be simultaneously used as one roll of the pinch roll pair.

Preferably, one roll of the pinch roll pair may comprise a pinch roll that acts only on the edge strip and the neighboring strip of the material web. Then a roll with a relatively short axial length may be used for the pinch roll so that the additional expense remains low in comparison to conventional reel cutters.

An edge strip receptacle may be advantageously disposed after the tensioning device in the travel direction of the material web. The edge strip receptacle may be disposed slightly farther away from the edge cutting device, and a well-aimed supply to the edge strip receptacle can nevertheless still be achieved. The supply takes place namely by means of the tensioning device. The tensioning device may therefore be moved closer to the edge cutting device, which in turn permits an improvement in the quality of the edge cut.

The edge strip receptacle may advantageously comprise a suction device. The edge strip may, therefore, be removed relatively quickly from the region behind the cutting device.

The tensioning device may be advantageously followed by a spreader device. The spreader device, however, acts only on the cut main part of the material web, but not on the edge strips. By means of this, the partial webs are separated, i.e. spread, from one another by a small distance.

The tensioning device may be advantageously followed by a subsequent treatment device for the material web without edge strips, wherein devices are provided which match the tensions of the subsequent processing device and the tensioning device to each other. For example, a subsequent processing device may be a reel winder with which the material web or its partial webs are wound into winding rolls. A certain tension is required for winding. If the tension, which the tensioning device exerts on the edge strips and possibly on neighboring regions of the material web, is synchronized or brought into agreement with this winding tension, then a clean edge cut may be obtained without thus resulting in a tension direction in the material web that deviates from the travel direction.

FIG. 1 shows an exemplary reel cutter 1 according to the present invention, used to divide a material web 2, for example a paper web, into a number of partial webs 3 and two edge strips 4. According to the present invention, damage that has occurred on the edges 5 of the material web 2 may be removed, i.e. cut away.

In a known manner, reel cutter 1 may have a cutting device 6 for this purpose, which has a number of blades 7 distributed over the width of the material web 2, and has a blade 8 in the vicinity of each of the edges 5. The latter blades 8 are used as edge cutting devices. "Blades" are understood to mean all cutting devices with which it may be possible to produce a longitudinal cut of the material web 2. Normally, these may be disk blades that travel against each other and function in accordance with the scissors cutting principle. However, other cutting devices may also be conceivable, for example, those that operate with sharp streams of water or with laser beams, and still be within the spirit and scope of the present invention.

While the partial webs 3 may be supplied by way of a spreader device 9 to a subsequent treatment device 10, e.g. a winder, the edge strips 4 are supplied to an edge strip receptacle 11, which may be provided with a suction device 12. By way of the edge strip receptacle 11, the edge strips 4 then travel into the pulper 13 or are supplied in another manner back to the production circuit. The suction device 12 may exert a certain tension on the edge strips 4. However, in the edge cutting device 8, this is not generally sufficient in order to bring the tension of the edge strips 4 into line with the tension of the partial webs 3, which is determined by the subsequent treatment device 10.

Figure 2:
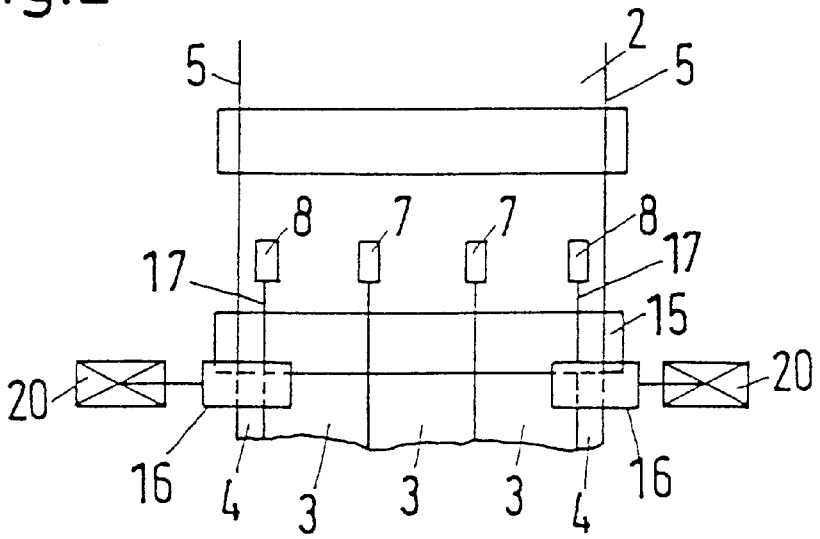
FIG. 2 is a schematic rear view of an exemplary reel cutter.

A guide roll 15 disposed after the cutting device 6 in the web travel direction 14 may be used to form a pinch roll pair with a pinch roll 16 in the region of each of the two edges 5. As shown in FIG. 2, the pinch rolls 16 may have a relatively small axial span. They may be only so wide that they protrude laterally beyond the edge strips 4 and therefore also respectively cover the region of the partial webs adjacent to the edge strips 4. In any case, it is assured that pinch rolls 16, together with guide roll 15, act on the edge strips 4 and the corresponding partial web 3 on both sides of a cutting line 17. In this manner, the web tension, which acts on partial web 3, may be transmitted to the edge strips 4 so that a uniform tension is exerted on both sides of the cutting line 17 even after the edge cutting device 8. As a result, a very clean cut may be produced even at higher production speeds.

In order to achieve an even better quality, the tension of the partial webs 3 may be determined in the subsequent treatment device 10, and transmitted to a control device 19. The control device 19 may be connected to drives 20 to then be used for pinch rolls 16. In this manner, it is possible to match the tensions for edge strips 4 to the tensions of partial webs 3 in a particularly precise manner so that pinch rolls 4 produce no change whatsoever in the course of partial webs 3.

An inlet section 21 may be disposed before cutting device 6 and other guide rolls 18 may be disposed in inlet section 21.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made within the purview of the appended claims, as presently stated and as amended, without departing from the scope and spirit of the present invention in its aspects. Although the present invention has been described herein with reference to particular means, materials, and embodiments, the present invention is not intended to be limited to the particulars disclosed herein; rather, the present invention extends to all functionally equivalent structures, methods and uses, such as are within the scope of the appended claims.

What is claimed is:

1. A reel cutter for a material web comprising:

an inlet section;

an outlet section;

a cutting device being located between said inlet section and said outlet section, and comprising an edge cutting device disposed in a region of at least one edge of the material web for producing a cutting line between at least one edge strip and a partial web;

a tensioning device associated with the edge cutting device and positioned to act on the at least one edge strip;

the tensioning device comprising a pinch roll pair; and the pinch roll pair arranged to laterally protrude beyond a cut line of the at least one edge strip so that the pinch roll pair acts on the at least one edge strip and at least a portion of the material web laterally adjacent to the at least one edge strip, wherein one pinch roll of the pinch roll pair is arranged on the cut line to contact only the one edge strip and the material web adjacent the cut line.

* * * * *